United States Patent [19]

Brachert et al.

[11] 4,051,207

[45] Sept. 27, 1977

[54] PROCESS FOR THE PRODUCTION OF PROPELLANT CHARGE POWDERS, ESPECIALLY NITROGUANIDINE POWDERS

[75] Inventors: Heinrich Brachert, Troisdorf-Oberlar; Joachim Kleiss, Liebenau, both of Germany

[73] Assignee: Dynamit Nobel Aktiengesellschaft, Troisdorf, Germany

[21] Appl. No.: 644,949

[22] Filed: Dec. 29, 1975

[30] Foreign Application Priority Data

Dec. 27, 1974 Germany ..... 2461646

[51] Int. Cl.[2] ..... C06B 21/00

[52] U.S. Cl. ..... 264/3 B; 149/96; 149/97; 149/98; 149/100

[58] Field of Search ..... 149/96, 98, 97, 100; 264/3 B

[56] References Cited

U.S. PATENT DOCUMENTS 3,928,514 12/1975 Brachert et al. ..... 264/3 B

*Primary Examiner*—Stephen J. Lechert, Jr.
*Attorney, Agent, or Firm*—Craig & Antonelli

[57] ABSTRACT

A process for producing propellant charge powders from solvent-containing mixtures such as nitroguanidine powders containing nitrocellulose and/ or nitrocellulose and diglycol dinitrate or nitroglycerin and nitroguanidine and additives wherein an alcohol-containing mixture or optionally a water-containing mixture of said propellant charge powders is premixed with additional components of the propellant powder, the mixture is first dried, if necessary, and the solvent is incorporated therein and the solvent-containing premix is homogenized and preplasticized in a kneading device or the water-containing premix is homogenized and preplasticized in the kneading device and then the resultant mixture is dewatered by drying and then combined with a solvent; then the solvent-containing mixture is plasticized in an extruder and converted thereby into granular form and the resulting granular material is extruded into a final product form in a screw-type extruder. Subsequently, the solvent is evaporated therefrom.

14 Claims, 1 Drawing Figure

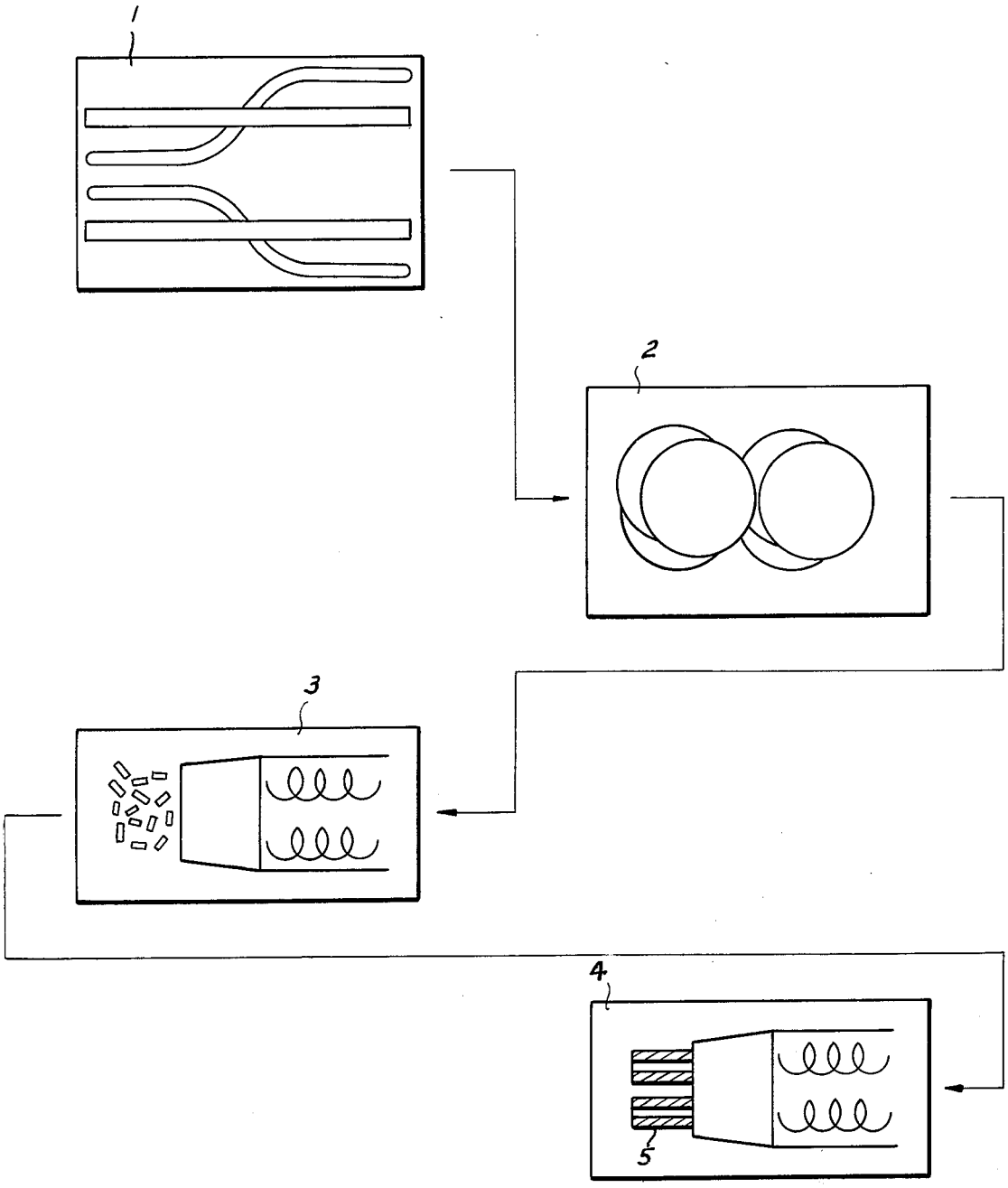
1
2
3
4
5

PROCESS FOR THE PRODUCTION OF PROPELLANT CHARGE POWDERS, ESPECIALLY NITROGUANIDINE POWDERS

This invention relates to a process for the production of propellant charge powders, namely solvent-containing single-and multiple-base propellant charge powders, especially nitroguanidine powders having a basis of nitrocellulose and/or nitrocellulose and diglycol dinitrate or nitroglycerin, as well s nitroguanidine, wherein the solvent-containing or optionally water-containing raw mixture of nitrocellulose and/or nitrocellulose and diglycol dinitrate or nitroglycerin is thoroughly mixed with the other components of the propellent charge powder, then dewatered if necessary, and the solvent incorporated, and then plasticized and finally pressed into the final powder product form.

It has been suggested to prepare solvent-free triple-base propellant charge powders, also called "Gudol" powders, according to an improved method by premixing a water-containing raw mixture of nitrocellulose and diglycol dinitrate with nitroguanidine and additives, reducing the water content in a first drying stage, and then homogenizing and preplasticizing this premix by means of a continuously operating kneader, and subsequently still further reducing the water content of this mixture in a second drying stage, whereafter the mixture is plasticized and converted into granular form by means of a continuously operating screw-type extruder, then the moisture of the granulated material is adjusted to the press moisture, and finally the granulated material is pressed into the final powder shape by means of a continuously operating screw-type extruder. In this previously proposed process, the individual components are fed continuously by way of metering devices to the mixing and/or kneading device, wherein the premixed components can pass repeatedly through this kneading device. Also, it is possible in this conventional method to pass the granulated material repeatedly through the extruder in order to attain further plasticization before conducting the final pressing of the granules into the final powder form. The advantages of this process reside primarily in that, in contrast to earlier methods for the production of propellant charge powders, the rolling into sheets and the production of coiled sheets to be processed in a barrel press are eliminated, which steps could generally be conducted only with manual operation of the respective devices and wherein, due to a more or less careful processing mode, considerable differences in the quality of the thus-obtained propellant powder were in most cases unavoidable since, for example, the rolling step had to be conducted batch-wise, and furthermore it was impossible to produce thereby a propellant powder uniform above all with respect to the internal ballistics properties in spite of the fact that an expensive manual sorting of the finally extruded powder tubes of different qualities was effected. All of these disadvantages could be overcome by the aforementioned earlier suggestion relating to solvent-free powders.

During working with this method described in connection with "Gudol" powders and starting with a water-containing raw mixture, considerations arose whether it would also be possible to process solvent-containing raw mixtures according to an extrusion process and to be able to produce in this way, for example, propellant powders having also a higher proportion of nitroguanidine of, for instance, 50–60% by weight, and other solvent-containing powders, e.g., single-base powders. It has been found that it is indeed possible, with a certain variation of the process conditions, to flawlessly further process even solvent-containing raw mixtures for propellant powders into granules, namely those having a very high proportion of nitroguanidine, e.g., from 30 to 60 % by weight, and also those containing no nitroguanidine at all or only up to 5% by weight of nitroguanidine, and finally to press this granulated material into the final powder form or shape in a screw-type extruder.

The process of this invention for the production of propellant powders from solvent-containing propellant charge mixtures having a basis of nitrocellulose and/or nitrocellulose and diglycol dinitrate or nitroglycerin, as well as nitroguanidine and further additives, is characterized in that an alcohol -containing or optionally a water-containing raw mixture having a basis of nitrocellulose is premixed with the further components of the propellant powder; then the mixture is either dried first of all, if necessary; and then the solvent is incorporated and the solvent-containing premix of the components is homogenized and preplasticized in a continuously operating kneader, e.g. a disk-type kneader; or first the water-containing premix of the propellants is homogenized and preplasticized in the continuously operating kneader, and only then the mixture is dewatered by drying and combined with a solvent; then the solvent-containing composition is plasticized in a continously operating extruder and converted thus into granular form, and this granulated material is finally extruded in a continuously operating extruder into the final powder product form, and the solvent is evaporated therefrom.

In the disk-type kneader utilized as the continuously operating kneading device, disks are arranged eccentrically on a horizontally disposed rotary shaft; these disks press the composition to be processed against the rotary shaft and the barrel wall surrounding the disks, in this way effecting the preplasticizing of the composition. For the plasticization and granulation steps, as well as the pressing of the granulated material into the final powder product form, e.g., in the form of tubes having an internal diameter of about 1–2 mm. and an external diameter of 3–5 mm., customary extruders can be employed, for example twin-screw extruders with two screws rotating in the same direction.

The special advantage of the above-described process of this invention resides primarily in that the once-produced premix can be further processed continously up to the final powder product form, thus being able to eliminate any manual influence whatever on the powder quality. Since all essential stages of the process can be automatically controlled by way of suitable control devices, far less personnel is required for the conductance of the process as contrasted to the previously customary processes, since it is merely necessary to monitor the control devices, and the constant presence of operating personnel in the vicinity of the plant and thus in the immediate danger zone is eliminated.

It is, of course, possible to provide that the premix passes repeatedly through the kneader as well as the extruder for the plasticizing of the mixture and for the granule production, or that several of these kneaders and/or several extruders are connected in series and are passed through by the premix in succession. This makes it possible, if desired and necessary, to obtain an even more uniform quality of the final product.

The process according to this invention will be set forth in greater detail in the following description and in conjunction with the process scheme illustrated in the drawing, wherein, for example, propellant powders of the following composition were produced:

1.

98.2% by weight of nitrocellulose
1.0% by weight of diphenylamine as stabilizer
0.8% by weight of potassium sulfate.

This powder was then aftertreated (i.e., admixed with) in a conventional manner with 1.0% by weight of dibutyl phthalate or diethyldiphenylurea for further compacting and hardening of the surface.

2.

72.2% by weight of nitrocellulose
21.7% by weight of diglycol dinitrate
4.6% by weight of nitroguanidine
0.8% by weight of methyldiphenylurea
0.7% by weight of potassium sulfate This powder was aftertreated with up to 2% by weight of dibutyl phthalate.

3.

19% by weight of nitrocellulose
18.7% by weight of nitroglycerin
55% by weight of nitroguanidine
7.3% by weight of diethyldiphenylurea This powder was aftertreated with 0.3% by weight of potassium sulfate, which has a flame-retardant effect and damps the muzzle flash.

The starting material was either a solvent-containing nitrocellulose comprising 30% by weight of an aliphatic alcohol, e.g., ethanol or isopropanol, based on the total weight of the starting material, or the water was displaced from an aqueous nitrocellulose by adding corresponding amounts of this alcohol. This nitrocellulose was mixed batchwise for ½ hour in the mixer-kneader 1 into a raw powder mixture together with the further components with the addition of 10–25% by weight, preferably 15–20% by weight of readily volatile solvent, e.g., acetone, ether, or ethyl acetate. Temperature within the mixer is maintained at room temperature. In the mixer-kneader 1, respectively two curved blades were mounted on two parallel-arranged shafts, taking care of an intensive intermixing of the propellant components. The thus-obtained premix was then directly introduced into the continuously operating disk-type kneader 2 wherein the premix was processed for 5 minutes without excess pressure, at temperatures of up to 80° C., i.e., from room temperature to 80° C. into a friable material, any water and also the solvent contained therein being squeezed out and separated from the friable material; this friable material was shaped into granules in the extruder 3 at temperatures in a heating zone of the extruder in the range of between 60° and 90° C.; and the granulated material was then shaped in extruder 4 into the final powder form, i.e., tubular products 5 with each composition a suitable product was obtained without any ignition.

Actually, it is basically also possible to mix the components of the propellant powder merely in the mixer-kneader 1 and then to introduce these components, after an intermediate drying step, e.g., at 40° to 60° C. directly into the extruder 3, wherein the mixing requires 4–5hours and a long maturing period of several days is absolutely required to be able to press the granules formed in the extruder 3 subsequently into the final shape of the powder product in extruder 4. However, it is in any event more advantageous to mix the components only in the mixer-kneader 1 and then to plasticize the components for about 1–3 runnings of 5 minutes each in the disk-type kneader 2 so that it is possible to conduct in extruder 3 as well as in extruder 4 an easier and above all continuous pressing of the powder mixture. Optionally, it can be advantageous to include a maturing period for the composition of about 24 hours in a container with a lid, equipped with a caulking, to avoid uncontrollable drying without any further mixing, subsequent to the plasticizing step in the disk-type kneader, in order to further improve the two continuous extrusion steps.

Accordingly, when conducting the process of this invention, it is thus possible to continuously produce propellant powders in the desired final powder product form even from solvent-containing raw mixtures, which is extraordinarily surprising to a person skilled in this field, inasmuch as the solvents could have triggered an ignition during the extrusion of the powder composition in the extruder and/or the solvents could have escaped uncontrollably from the extruder, which would have altered the properties of the powder products in an undesired and above all ungovernable manner. Furthemore, it is surprising that also powder mixtures having very high proportions of energy-rich, crystalline solid, i.e., nitroguanidine, which can entirely or partially be replaced by penthrite (nitropentaerythritol) and/or hexogen (cyclotrimethylenetrinitramine), on the order of 50–60% by weight, can be processed in the extruder without difficulties, if operating under the conditions of the process according to the present invention.

It will be understood that the conditions of the process of this invention may be summarized as follows:

The proportions of the individual components of the propellant powder may vary between the following limits:

TABLE 1

| | Wt. % |
|---|---|
| Nitrocellulose | 15 to 99 |
| Diglycol dinitrate | 0 to 40 |
| Nitroguanidine | 0 to 60 |
| Nitroglycerin | 0 to 40 |
| Softener, e.g. Camphor | 0 to 10 |
| Stabilizers, e.g. Diethyldiphenylurea | 0.5 to 2 |
| Equalizer, e.g. wax | 0.1 to 0.5 |
| Other additional materials such as potassium sulfate and sodium oxalate less than | 2 |

The total proportions of the various components are, in each use determined such that the total mixture adds up to 100%.

The proportion of aliphatic alcohol admixed with the raw propellant mixture may vary from 20 to 40% by weight based on the weight of the nitrocellulose. Suitable alcohols are ethyl alcohol and isopropyl alcohol.

Alternatively, the untreated nitrocellulose may contain 20 to 40% by weight of water.

The solvent added to the alcohol-containing premix may be ethylether or acetone and may constitute from 50 to 120% by weight of the nitrocellulose.

TABLE 2

| Unit | Temperature °C. | Time hrs. | Pressure psig |
|---|---|---|---|
| Mixer-kneader 1 | room temperature | 0.5 to 4 | without excess pressure |

TABLE 2-continued

| Unit | Temperature ° C. | Time hrs. | Pressure psig |
|---|---|---|---|
| Kneader 2 | 20 to 50 | 5 to 15 | without excess pressure |
| Extruder 3 | 50 to 80 | 5 | 500 to 4,000 |
| Extruder 4 | 50 to 80 | 5 | 1,000 to 4,000 |

It will also be recognized that no special, i.e., unconventional, devices, are required. Known apparatus for the processing of propellant materials can be utilized. For example, a kneader with Sigma blades may be for the mixer kneader and the continuous disk kneader 2 may be a kneader with helically eccentrically arranged disks. Extruders 3 and 4 may have one or more screws.

The alcohol-ether mixture, acetone or ethyl acetate referred to as a solvent serves as a swelling agent or as a gelatinizing agent since the amount of this material used is not sufficient to dissolve the nitrocellulose. Thus it will be understood that the nitrocellulose fibers are merely swelled by the use of these solvents and that their structure is not destroyed.

What is claimed is:

1. A process for the production of propellant charge powders from solvent-containing mixtures containing nitrocellulose, and components selected from the group consisting of diglycol dinitrate, nitroglycerin, nitroguanidine, penthrite, and hexogen and mixtures thereof, and further additives, which comprises premixing an alcohol-containing or a water-containing raw mixture containing nitrocellulose with additional required components of the propellant powder; then either incorporating a solvent in the alcohol-containing mixture and homogenizing and preplasticizing the solvent-containing premix of the components in a continuously operating kneading device or homogenizing and preplasticizing the water-containing premix of the components in the continuously operating kneading device, then only thereafter dewatering the mixture by drying and combining the mixture with a solvent; then plasticizing the solvent-containing preplasticized mixture in a continuously operating screw-type extruder; converting the resultant mixture into granular form; extruding the granulated material finally into a final powder form in a continuously operating screw-type extruder; and evaporating the solvent therefrom.

2. A process according to claim 1, wherein a disk-type kneader is employed as the continuously operating kneading device.

3. A process according to claim 1, wherein the process is carried out in the kneading device without the use of excess pressure at temperatures of up to 80° C.

4. A process according to claim 1, wherein the premix is preplasticized for 3 to 5 minutes in the kneading device.

5. A process according to claim 1, wherein the powder mixture, after preplasticizing in the kneading device, is allowed to mature for about 24 hours and is only thereafter extruded.

6. A process according to claim 1, wherein a premix for a single-base propellant powder is produced and this premix is further processed.

7. A process according to claim 1, wherein a premix for a triple-base propellant powder with up to 5% by weight of nitroguanidine is produced and this premix is then further processed.

8. A process according to claim 1, wherein a premix for a triple-base propellant powder with 50–60% by weight of nitroguanidine is produced and this premix is then further processed.

9. A process according to claim 1 wherein the alcohol-containing nitrocellulose is mixed with the required components under the addition of 10–25% by weight of a readily volatile solvent.

10. A process according to claim 9, wherein the solvent is acetone.

11. A process according to claim 8, wherein an aqueous raw powder mixture is utilized, the water is removed therefrom by drying, and the mixture is combined with a readily volatile solvent, preferably acetone.

12. A process according to claim 11, wherein the solvent is acetone.

13. A process according to claim 11, wherein the water is removed by drying the raw powder mixture at 40° to 60° C.

14. A process according to claim 1, wherein an aqueous raw mixture is utilized and after premixing said mixture is initially dried and then the solvent is incorporated and the homogenizing and preplasticizing are effected.

* * * * *